US005884797A

United States Patent [19]

Asbach

[11] Patent Number: 5,884,797

[45] Date of Patent: Mar. 23, 1999

[54] HINGELESS LID

[75] Inventor: Ronald M. Asbach, Grand Island, N.Y.

[73] Assignee: Fisher-Price, Inc., East Aurora, N.Y.

[21] Appl. No.: 698,373

[22] Filed: Aug. 15, 1996

[51] Int. Cl.[6] ..... B65D 43/14

[52] U.S. Cl. ..... 220/331; 220/335; 220/379

[58] Field of Search ..... 220/331, 332, 220/334, 335, 379

[56] References Cited

U.S. PATENT DOCUMENTS

| | | | |
|---|---|---|---|
| D. 252,718 | 8/1979 | Taylor . | |
| D. 282,032 | 1/1986 | Lemmeyer . | |
| D. 296,026 | 5/1988 | Sugarman et al. . | |
| D. 303,883 | 10/1989 | Higson et al. . | |
| D. 328,221 | 7/1992 | Piccarillo . | |
| D. 338,923 | 8/1993 | Ran . | |
| D. 340,565 | 10/1993 | Klopfenstein . | |
| D. 347,916 | 6/1994 | Russ . | |
| D. 352,148 | 11/1994 | Shively et al. . | |
| D. 352,584 | 11/1994 | Boyd . | |
| D. 353,727 | 12/1994 | Sun . | |
| D. 361,220 | 8/1995 | Cacciola . | |
| D. 371,663 | 7/1996 | Muller-Deisig et al. . | |
| D. 371,664 | 7/1996 | Ponce et al. . | |
| 1,842,603 | 1/1932 | Gray | 220/335 |
| 2,472,491 | 6/1949 | Quinton . | |
| 2,555,178 | 5/1951 | Young . | |
| 2,581,892 | 1/1952 | White . | |
| 2,667,397 | 1/1954 | Hallisey . | |
| 3,241,750 | 3/1966 | Brighton . | |
| 3,392,820 | 7/1968 | Azim | 220/335 X |
| 3,707,279 | 12/1972 | Kaiser . | |
| 3,711,110 | 1/1973 | Logerquist . | |
| 3,850,342 | 11/1974 | Dsjuba | 220/335 X |
| 3,866,936 | 2/1975 | Hedges . | |
| 3,876,223 | 4/1975 | O'Reilly et al. . | |
| 4,066,156 | 1/1978 | Basile . | |
| 4,308,972 | 1/1982 | McReynolds et al. | 220/335 |
| 4,345,697 | 8/1982 | Wilson et al. | 220/335 |
| 4,572,401 | 2/1986 | Grenier . | |
| 4,585,139 | 4/1986 | Bronson et al. . | |
| 4,635,950 | 1/1987 | Le Sage et al. . | |
| 4,789,180 | 12/1988 | Bell . | |
| 4,790,549 | 12/1988 | Armand . | |
| 4,842,289 | 6/1989 | Samuels . | |
| 4,864,334 | 9/1989 | Ellis . | |
| 4,889,360 | 12/1989 | Havlovitz . | |
| 4,971,220 | 11/1990 | Kaufman et al. | 220/335 |
| 5,013,055 | 5/1991 | Labrum . | |
| 5,036,997 | 8/1991 | May et al. . | |
| 5,106,112 | 4/1992 | Sargent . | |
| 5,114,165 | 5/1992 | Vogel . | |
| 5,116,289 | 5/1992 | Pond et al. . | |

(List continued on next page.)

OTHER PUBLICATIONS

Fisher–Price Product No. 9498 ("2–in–1 Toy Box"), 8 photographs. Date Unknown.

*Primary Examiner*—Stephen K. Cronin
*Attorney, Agent, or Firm*—Morgan, Lewis & Bockius LLP; C. Scott Talbot; Howard R Richman

[57] ABSTRACT

A hingeless lid for use with a container can be closed by a child while reducing the likelihood of a freefalling lid. The hingeless lid can be used with a toy box or any application that includes a horizontal and vertical lid position, and especially where it is desirable to reduce the likelihood of a freefalling lid. The hingeless lid of the invention includes a plurality of hingeless couplers, each coupler including a container portion having a plurality of ridges and pivots and a lid portion having a plurality of W-shaped members depending downwardly from the bottom surface of the lid. The W-shaped members include a first plurality of saddles for engaging the ridges and a second plurality of saddles for engaging the pivots. The engagement of the saddles and the ridges retains the lid against back-and-forth horizontal movement when the lid is in a closed position. The engagement of the saddles with the pivots provides a lever action and urges the lid into a frictional engagement with the container to retain the lid in an open position. The hingeless lid permits a substantially frictionless movement from a closed position to an open position, while frictionally resisting movement from an open position to a closed position.

10 Claims, 7 Drawing Sheets

U.S. PATENT DOCUMENTS 5,123,187 6/1992 Zamaria .
5,139,278 8/1992 Vlasicak .
5,150,806 9/1992 Glomski .
5,169,164 12/1992 Bradford .
5,178,244 1/1993 Liang .
5,207,723 5/1993 Newby, Sr. .
5,209,345 5/1993 Haugabook ..... 220/335
5,215,318 6/1993 Capraro .
5,230,525 7/1993 Delmerico et al. .
5,244,220 9/1993 Cortez .
5,249,438 10/1993 Rhaney et al. .
5,259,215 11/1993 Rocca .
5,273,298 12/1993 Brown, Sr. .
5,277,449 1/1994 Schmidt .
5,290,049 3/1994 Crisp et al. .
5,291,976 3/1994 Ku .
5,294,137 3/1994 Barber et al. .
5,313,817 5/1994 Meinders .
5,318,314 6/1994 Cyphers et al. .
5,318,315 6/1994 White et al. .
5,333,885 8/1994 Pullman .
5,338,049 8/1994 Goring .
5,338,054 8/1994 Imai et al. .
5,374,073 12/1994 Hung-Hsin .
5,385,220 1/1995 Pond et al. .
5,423,651 6/1995 Dinverno .
5,456,342 10/1995 Rekuc .
5,458,350 10/1995 Johnson et al. .
5,511,807 4/1996 Snyder .
5,513,066 4/1996 Berman .
5,528,453 6/1996 Berman et al. .
5,639,002 6/1997 Weitbrecht et al. ..... 220/335 X

HINGELESS LID

BACKGROUND OF THE INVENTION

The present invention relates to lids for containers, and particularly to hingeless lids. More particularly, the invention relates to hingeless lids the are movable substantially without frictional resistance from a closed position to an open position, but which encounter frictional resistance to movement from the open position to the closed position.

In certain applications, such as children's toy boxes, it is important to avoid free-falling lids that can injure a child. In fact, voluntary toy standards, adhered to by most toy manufacturers, dictate that a hinged lid will not free fall. Of course, it is desirable to follow the voluntary standard in the case of hingeless lids as well.

Various approaches have been tried to reduce the likelihood of freefalling hingeless lids. For example, conventional hingeless lids have been rotated to an open position where they drop into a slot or opening in the top of the toy box. Dropping the lid into the slot provides a mechanical interlock that keeps the lid in the open position. In order to close the toy box, the lid must be lifted out of the slot before it can be rotated to the closed position, so that simply bumping into the lid will not cause the lid to fall. Unfortunately, children have had difficulty lifting, and therefore closing, such a hingeless lid. As a result, the toy boxes have remained open until parents closed the lid. While closing the lid is not difficult for a parent, it is sometimes inconvenient. A better approach would provide a lid that can be easily closed by a child while simultaneously reducing the likelihood of a freefalling lid.

SUMMARY OF THE INVENTION

The present invention provides a lid for use with a container that can be closed by a child while reducing the likelihood of a freefalling lid. Such a lid can be used with a toy box or any application that includes a horizontal and vertical lid position, and especially where it is desirable to reduce the likelihood of a freefalling lid.

The hingeless lid of the invention includes a plurality of hingeless couplers. The couplers include a container portion having a plurality of ridges and pivots and a lid portion having a plurality of W-shaped members depending downwardly from the bottom surface of the lid. The W-shaped members include a first plurality of saddles for engaging the ridges and a second plurality of saddles for engaging the pivots.

The engagement of the first plurality of saddles and the ridges retains the lid against back-and-forth horizontal movement when the lid is in a closed position. The engagement of the second plurality of saddles with the pivots provides a lever action and urges the lid into a frictional engagement with the container to retain the lid in an open position. Advantageously, the present hingeless lid permits a substantially frictionless movement from a closed position to an open position, while frictionally resisting movement from an open position to a closed position. Thus, the present invention allows a child to freely open the lid, but requires the child to apply a continuing force to the lid, rather than merely bumping against the lid, to move the lid from the open position to the closed position. Accordingly, the likelihood that the lid will freefall is reduced and, additionally, the lid will remain unattended in intermediate positions between the fully open position and the closed position.

DETAILED DESCRIPTION

Figure 1:
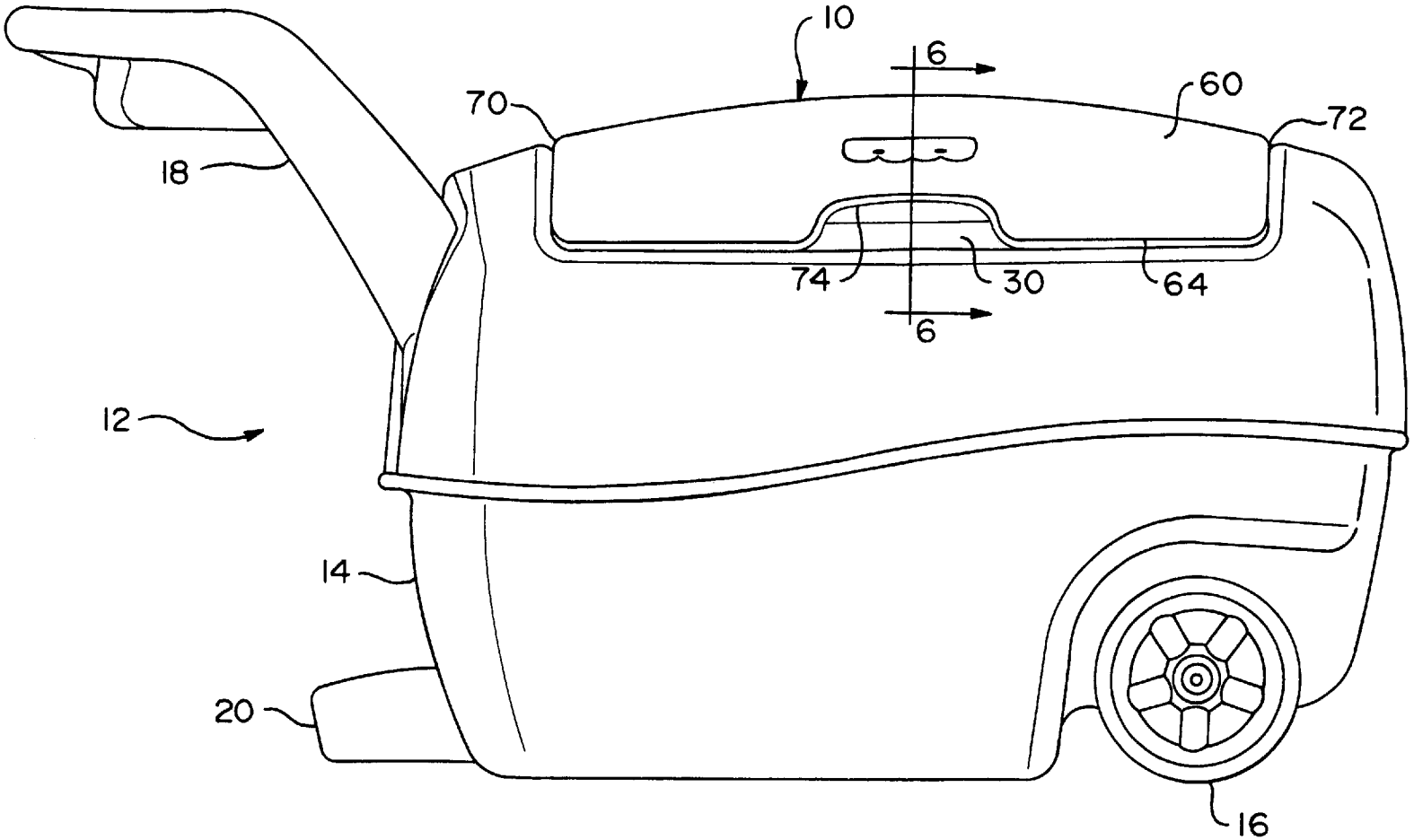
FIG. 1 is a side view of a toy box incorporating a hingeless lid according to the present invention.
Figure 2:
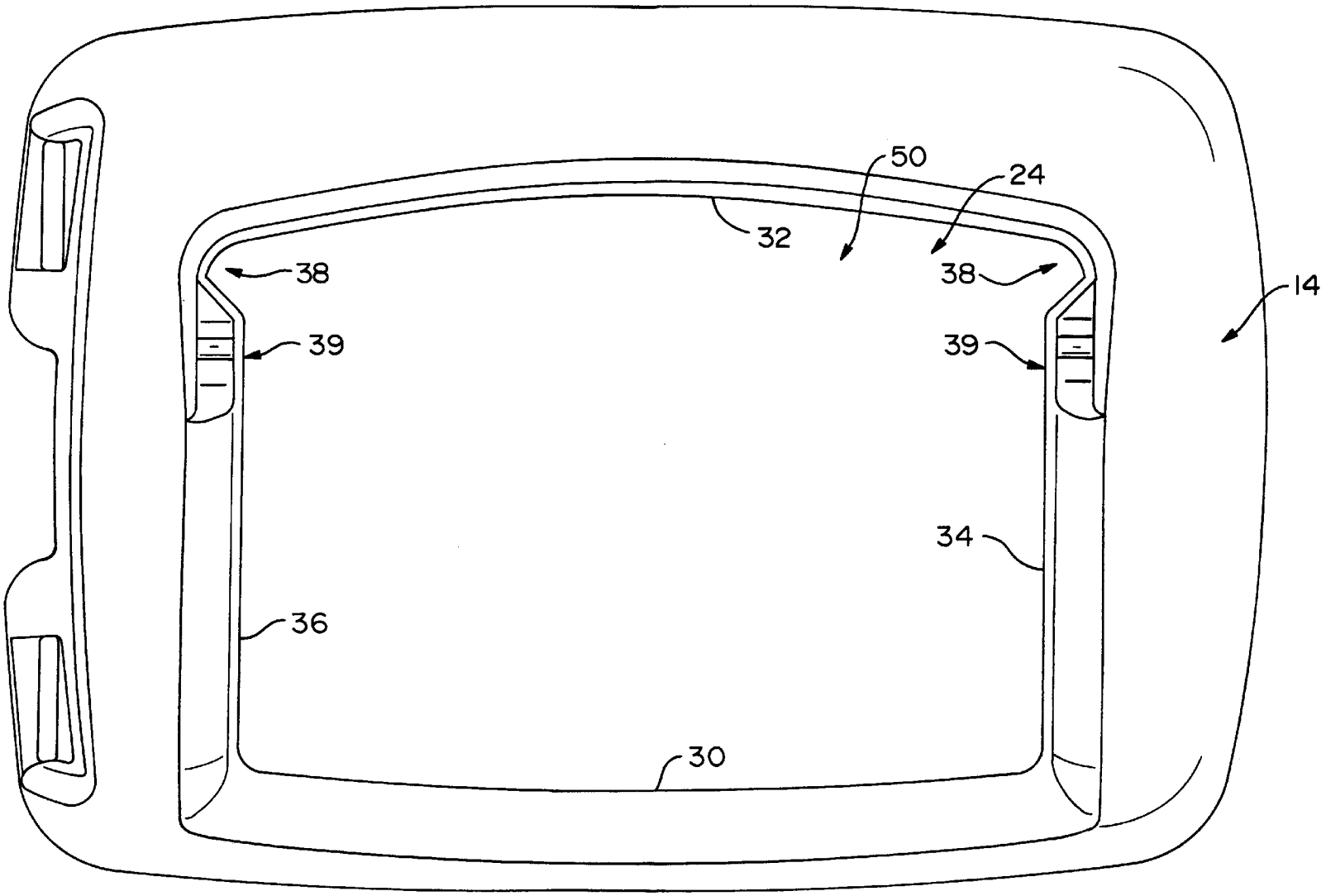
FIG. 2 is top view of the container portion of the toy box of FIG. 1 with the lid removed.

A hingeless lid 10 according to the present invention is suitable for use with a toy box as illustrated in FIG. 1. The illustrated toy box 12 includes a container 14 mounted on wheels 16 with a handle 18 attached thereto. A lower shelf 20 is provided to cooperate with the handle 18 to hold long objects. The toy box 12 also includes an opening 24 (FIG. 2) that is defined, in combination, by a front edge 30, a back edge 32, and a pair of side edges 34, 36. The lid 10 closes the opening 24.

Figure 5:
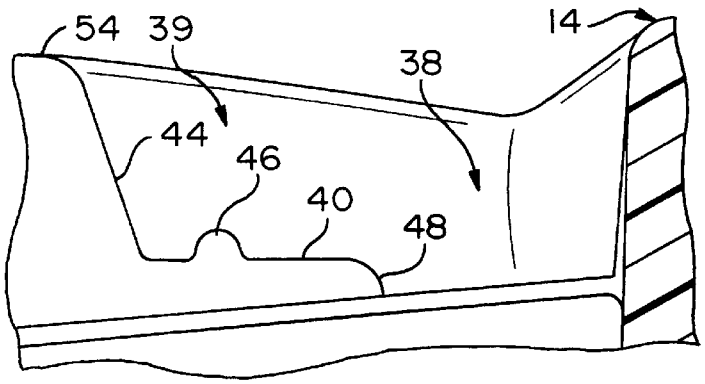
FIG. 5 is a partial section view through the container showing the container portion of the hingeless coupler.
Figure 9:
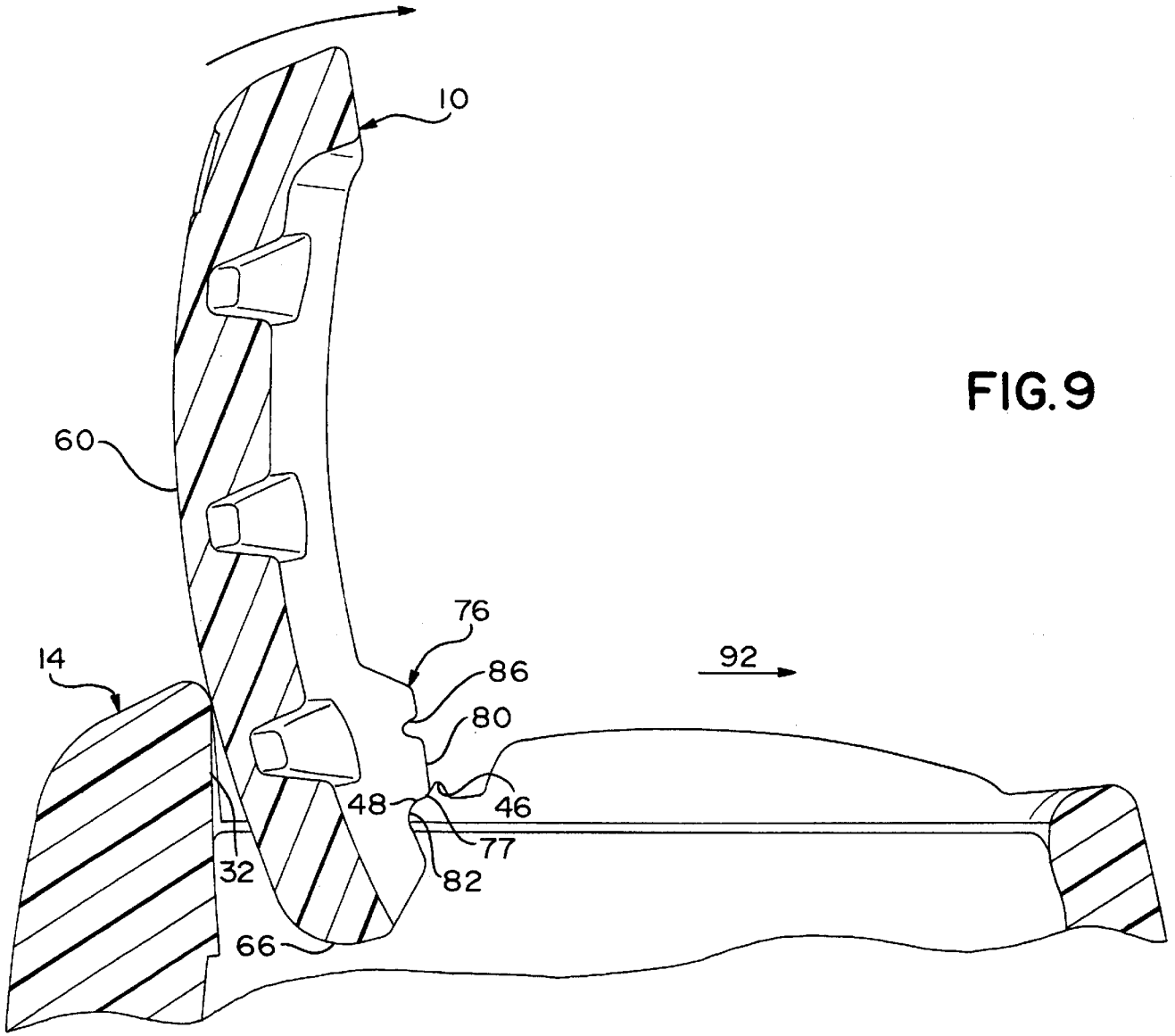
FIG. 9 is a view similar to FIG. 8 with the lid in the fully open position.

The side edges 34, 36 include a notch 38 extending forwardly from the back edge 32 to a recess 39 (FIG. 5) defined by a lower platform 40 and a ramping surface 44. The lower platform 40 extends forwardly from the notch 38 to the upwardly ramping surface 44 which joins an upper surface 54 extending forwardly from the ramping surface 44 to the front edge 30. The platform 40 includes a ridge 46 and a rounded edge 48, adjacent the notch 38, that forms a pivot about which the lid 10 can pivot. The notches 38 cooperate to define an enlarged portion of the opening 24 that acts as a virtual slot 50 for receiving the lid 10 when the lid 10 is in an open position (FIG. 9).

Figure 3:
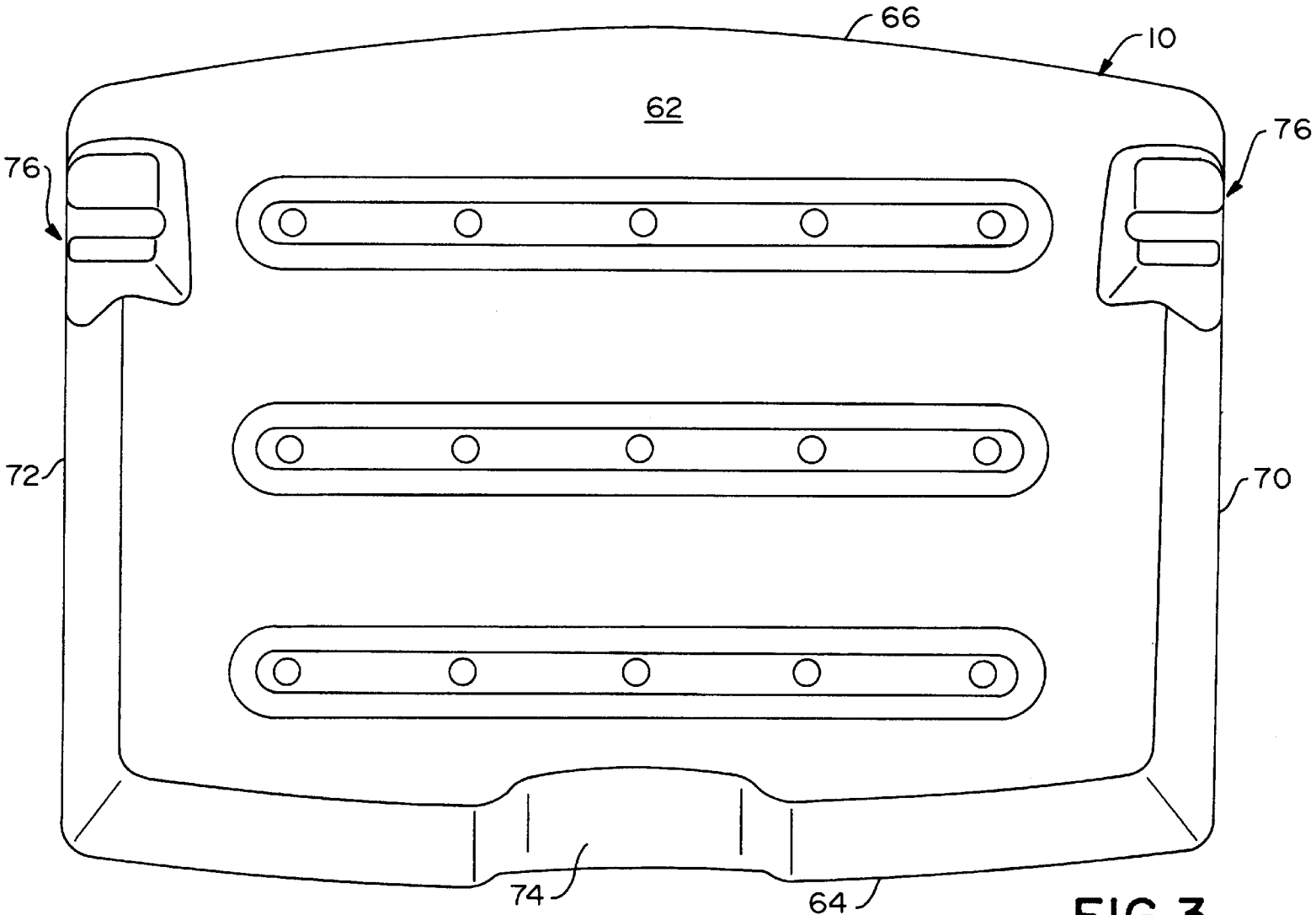
FIG. 3 is a bottom view of the hingeless lid.
Figure 4:
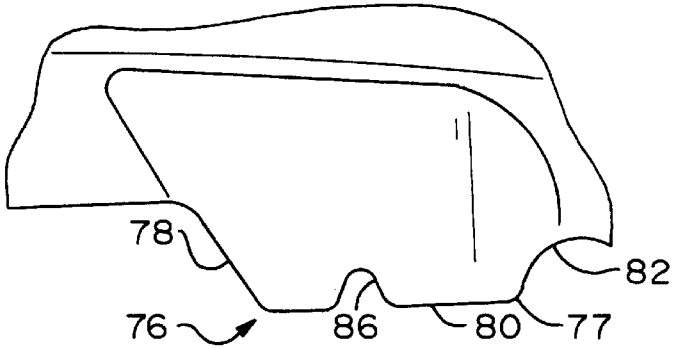
FIG. 4 is a side view of the lid portion of a hingeless coupler.
Figure 6:
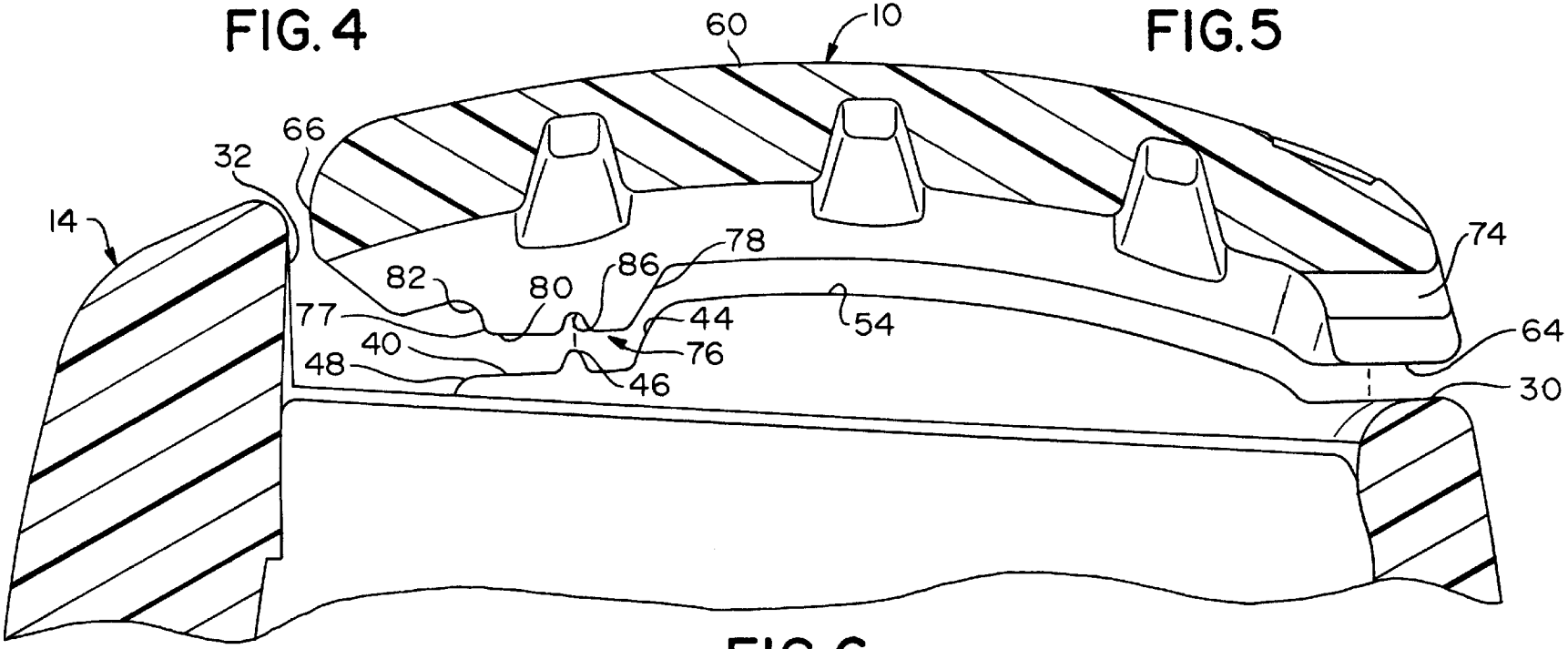
FIG. 6 is a section view taken along lines 6—6 of FIG. 1 showing the lid slightly above its normal closed position.

As best illustrated in FIG. 3, the lid 10 includes a top surface 60 (FIG. 1), a bottom surface 62, a front edge 64, a back edge 66, and a pair of side edges 70, 72. A hand hold 74 is formed in the front edge 64. A pair of couplers 76 (FIG. 4) extend downwardly from the bottom surface 62 adjacent each side edge 70, 72. The couplers 76 are generally W-shaped and include a downwardly sloping surface 78 that joins a bottom surface 80. The bottom surface 80 extends rearwardly from the sloping surface 78 to a contact point 77, where the bottom surface 80 meets an arcuate portion 82. The arcuate portion 82 curves upwardly-and-rearwardly from the bottom surface 80 and forms an approximate quarter-circle before continuing the rearward extension to the back edge 66 of the lid 10.

The bottom surface 80 includes a first saddle 86 that is contoured to generally match the ridge 46. The arcuate portion 82 provides a second saddle configured to have approximately the same radius of curvature as the pivot 48. In addition, the downwardly sloping surface 78 is operatively parallel to the upwardly ramping surface 44. Thus, the W-shaped couplers 76 are sized and configured to fit in, and mate with, the recess 39. It will be appreciated that the purpose of the ridge 46 is to prevent front-to-back movement of the lid 10 in the opening 24. Accordingly, the coupler 76 will work without the ridge 46 and, therefore, without the first saddle 86. Thus, although preferred couplers 76 as discussed herein are W-shaped, other effective couplers can be generally rectangular or trapezoidal.

Figure 7:
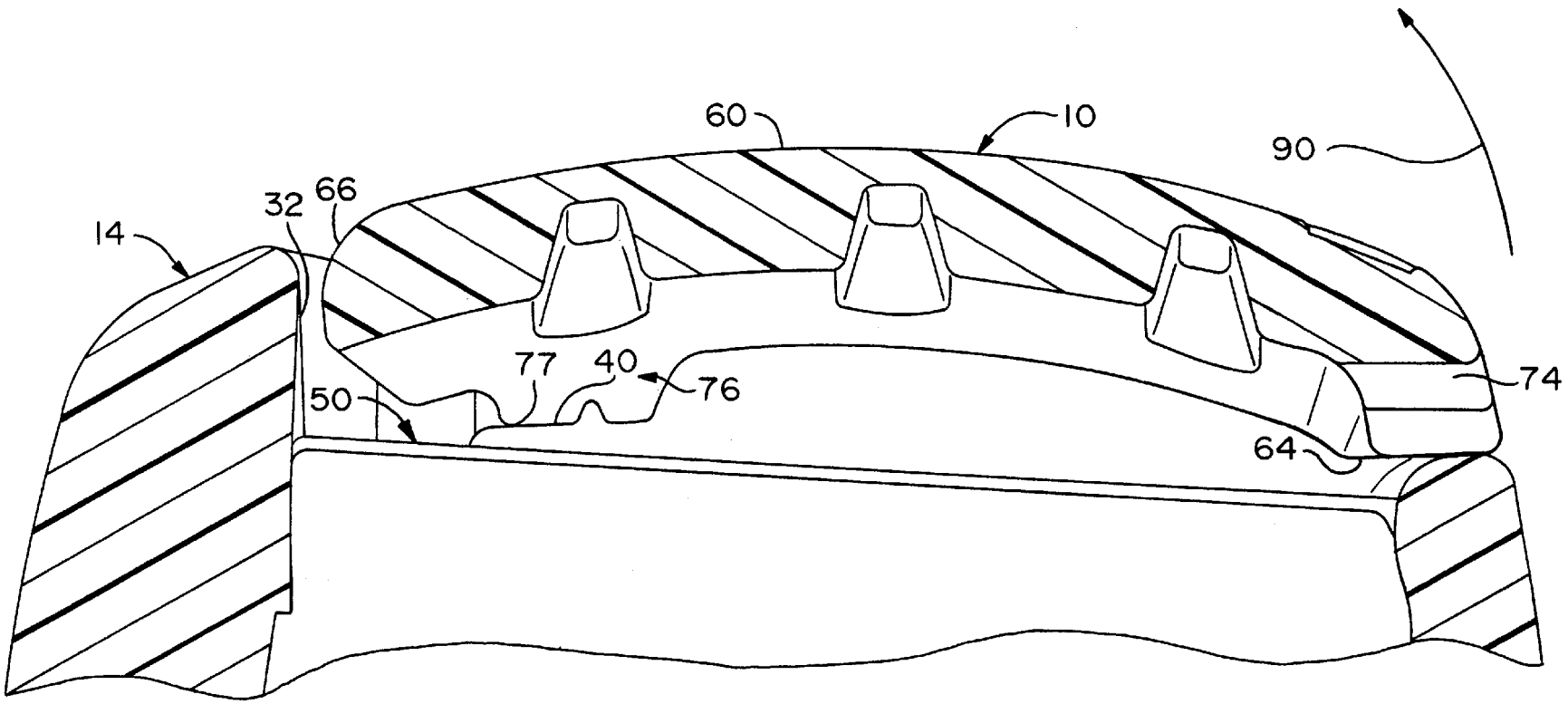
FIG. 7 is a view similar to FIG. 6 with the lid resting on the container in the closed position.
Figure 8:
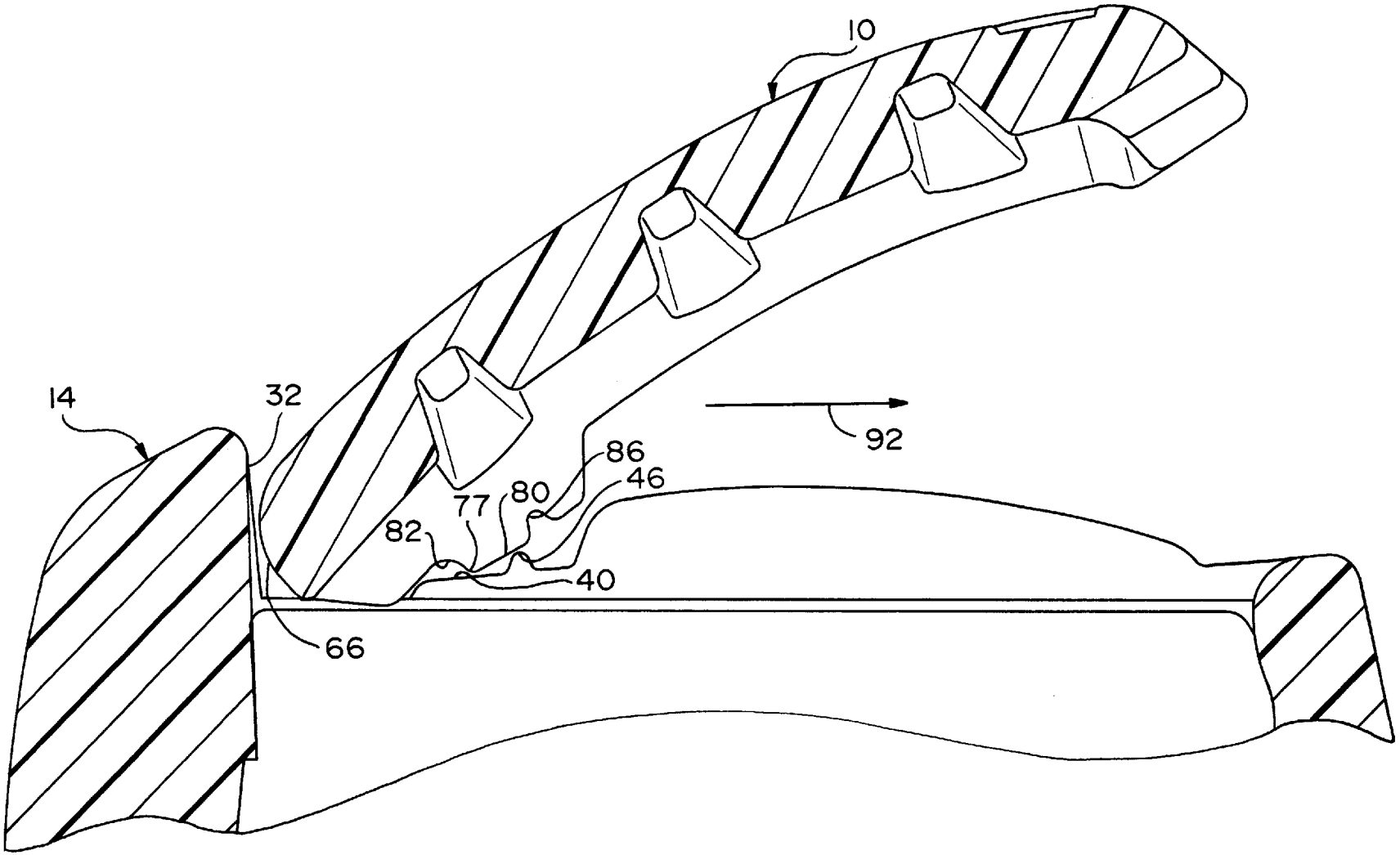
FIG. 8 is a view similar to FIG. 7 with the lid partially open.

In operation, the closed lid 10 rests on the opening 24, as illustrated in FIG. 7, with the front edge 64 of the lid 10 resting on the front edge 30 of the opening 24, and the first saddles 86 resting on the ridges 46. To raise the lid 10 to the open position, a user grasps the lid 10 by the hand hold 74 and raises the front edge 64, rotating the lid 10 in the direction of arrow 90 about the contact point 77, which is supported by the lower platform 40, as illustrated in FIG. 8. As the lid 10 rotates about the contact point 77, the back edge 66 of the lid 10 moves generally downwardly into the virtual slot 50 and the rear portion of the lid's top surface 60 moves downwardly and rearwardly into contact with the back edge 32 of the opening 24, as illustrated in FIG. 8.

The contact between the opening's back edge 32 and the lid's top surface 60 causes the rearmost portion of the lid 10 to translate forwardly in the direction of arrow 92. During the translation, the contact point 77 moves forwardly along the lower platform 40. As the lid 10 continues to rotate, the back edge 66 of the lid 10 moves farther into the slot 50 and the arcuate portion 82 conformingly engages the pivot 48, with the contact point 77 disposed adjacent the ridge 46, as illustrated in FIG. 9. Of course, the contact between the opening's back edge 32 and the lid's top surface 60 will result in some friction. However, since the coupler 76 is free to slide on the contact point 77 along the lower platform 40, rather than being hinged, any friction that is produced causes minimal resistance to movement of the lid so that there is substantially frictionless movement from the closed position to the fully open position.

In preferred embodiments, the fully open position is approximately 10 degrees past the vertical. Thus, the fully open position is slightly past overcenter and the lid 10 tends to remain in the fully open position by the action of gravity. To close the lid 10, a user must pull the lid 10 toward the closed position. The initial movement of the lid 10 past the vertical is essentially unimpeded. Thus, even a slight bump could send the lid 10 back overcenter toward the closed position. However, once past overcenter, it is highly desirable that the lid not be permitted to freefall. The present invention reduces the likelihood of a freefalling lid by frictional engagement of the top surface 60 with the back edge 32.

Pulling the lid 10 toward the closed position, without lifting it, causes the lid 10 to rotate about the pivot 48. However, since the contact point 77 is adjacent the ridge 46, rotation of the lid 10 brings the bottom surface 80 of the coupler 76 into contact with the ridge 46. The contact pushes the lid 10 rearwardly opposite to the direction of arrow 92, with the contact point 77 moving along the lower platform 40. As the lid 10 moves rearwardly, the top surface 60 contacts the back edge 32 of the opening 24. Continued rotation tends to move the back edge 66 of the lid 10 upwardly along the back edge 32 of the opening 24. However, the movement is opposed by the resulting friction between the top surface 60 and the back edge 32.

Up to a predetermined position, the friction is sufficient to overcome gravity tending to close the lid 10. Thus, if a child lets go at an intermediate position between the fully open and the predetermined position, and does not apply a continuous force past the predetermined position, the frictional force will maintain the lid 10 at the intermediate position. Moreover, if the child does not open the lid all the way past overcenter to the fully open position, the lid will remain open, without support, so long as the lid has passed the predetermined position. However, as the lid 10 continues to rotate opposite the direction of arrow 90, the center of gravity moves forwardly in the direction of arrow 92 relative to the pivoting contact between the contact point 77 and the lower platform 40. Beyond the predetermined position, the moment arm of the center of gravity increases to the point where the weight of the lid 10, acting at that distance, is sufficient to overcome the frictional resistance, and the lid 10 continues closing on its own.

The various factors involved in generating and sustaining the friction force opposing lid closure can be changed as desired to increase or decrease the amount of friction opposing the closing movement. For example, the gap between the closed lid 10 and the opening 24 can be increased or decreased by decreasing or increasing, respectively, the dimensions of the lid 10 relative to the opening, or the couplers 76 can be moved forwardly or rearwardly relative to the back edge 32 of the opening 24 and the back edge 66 of the lid 10.

While the lid 10 has been described in relation to a toy box, it will be appreciated that the lid 10 is not limited to use with just toy boxes, but can be used in any application that requires a lid to move between horizontal and vertical positions, and especially where it is desirable to avoid a freefalling lid. For example, the lid is also useful for children's tables and desks that include a storage area beneath the lid.

The lid 10 is preferably blow molded using conventional materials and techniques. However, it will be appreciated that the lid can be made from any suitable material and appropriate manufacturing techniques as determined by the particular application.

What is claimed is:

1. In combination with a container having an opening and an interior region, a hingeless lid comprising:

at least one coupler including a first saddle engagable with a ridge formed on the container to limit forward and backward movement of the lid when the lid is in a closed position, and a second saddle engagable with a pivot formed on the container when the lid is in an open position; and a back edge that rests in a slot formed in the container when the lid is in the open position, the back edge extending into the interior region.

2. The lid of claim 1 wherein the lid further includes a top surface, the second saddle and the pivot cooperating to urge the top surface into a frictional engagement with a back edge of the opening during movement of the lid from the open position to a closed position.

3. In combination with a container having an opening, a lid comprising:

a top surface and a bottom surface held in spaced-apart relation by a pair of side edges, a front edge and a back edge; and at least one hingeless coupler attached to the bottom surface and including a first portion and an arcuate portion disposed adjacent the first portion, wherein the first portion is generally W-shaped and includes a first saddle configured to ride on a ridge disposed in the opening and the arcuate portion includes a second saddle configured to interact with a pivot disposed in the opening.

4. The lid of claim 3 wherein an interaction between the second saddle and the pivot retains the lid in an open position and, in combination with an interaction between the top surface of the lid and an edge of the opening, opposes movement of the lid from the open position to a closed position.

5. In combination with a container, a hinieless lid comprising:

a bottom surface; and at least one coupler comprising a first portion and an arcuate portion disposed adjacent the first portion, wherein the first portion is generally W-shaped and includes a first saddle configured to ride on a ridge disposed in an opening in the container and the arcuate portion includes a second saddle configured to interact with a pivot disposed in the opening, said at least one coupler depending from the bottom surface for engaging the container to provide substantially frictionless movement from a closed position to an open position and friction-restrained movement from the open position to the closed position.

6. The lid of claim 5 wherein an interaction between the second saddle and the pivot retains the lid in the open position and, in combination with an interaction between the top surface of the lid and an edge of the opening, opposes movement of the lid from the open position to the closed position.

7. A toy box comprising:

a container;

a plurality of wheels coupled to the container;

a handle coupled to the container;

a lower shelf attached to the container and disposed below the handle;

a lid removably coupled to the container, the lid being sized and configured for frictional engagement with the container to retain the lid in an open position; and at least one coupler comprising a first portion and an arcuate portion disposed adjacent the first portion, wherein the first portion is generally W-shaped and includes a first saddle configured to ride on a ridge disposed in an opening in the container and the arcuate portion includes a second saddle configured to interact with a pivot disposed in the opening, said at least one coupler depending from a bottom surface of the lid for engaging the container to provide substantially frictionless movement from a closed position to an open position and friction-restrained movement from the open position to the closed position.

8. The toy box of claim 7 wherein an interaction between the second saddle and the pivot retains the lid in the open position and, in combination with an interaction between the top surface of the lid and an edge of the opening, opposes movement of the lid from the open position to the closed position.

9. A hingeless coupler for coupling a lid to a container the coupler comprising:

a lid portion attached to the lid;

a container portion attached to the container, the lid portion and the container portion being configured to render the lid self-supporting at an intermediate position between a fully open position and a closed position; and at least one coupler comprising a first portion and an arcuate portion disposed adjacent the first portion, wherein the first portion is generally W-shaped and includes a first saddle configured to ride on a ridge disposed in an opening in the container and the arcuate portion includes a second saddle configured to interact with a pivot disposed in the opening, said at least one coupler depending from a bottom surface of the lid for engaging the container to provide substantially frictionless movement from a closed position to the fully open position and a friction-restrained movement from the fully open position to the closed position.

10. The coupler of claim 9 wherein an interaction between the second saddle and the pivot retains the lid in the fully open position and, in combination with an interaction between the top surface of the lid and an edge of the opening, opposes movement of the lid from the fully open position to the closed position.

* * * * *